US009447670B2

(12) United States Patent
Hofman et al.

(10) Patent No.: US 9,447,670 B2
(45) Date of Patent: Sep. 20, 2016

(54) SELF-ORIENTING FRACTURING SLEEVE AND SYSTEM

(76) Inventors: Raymond Hofman, Midland, TX (US); Steve Jackson, Richmond, TX (US)

( * ) Notice: Subject to any disclaimer, the term of this patent is extended or adjusted under 35 U.S.C. 154(b) by 712 days.

(21) Appl. No.: 13/228,518

(22) Filed: Sep. 9, 2011
(Under 37 CFR 1.47)

(65) Prior Publication Data

US 2012/0152523 A1 Jun. 21, 2012

Related U.S. Application Data

(60) Provisional application No. 61/381,376, filed on Sep. 9, 2010.

(51) Int. Cl.
*E21B 43/26* (2006.01)
*E21B 17/10* (2006.01)

(52) U.S. Cl.
CPC ..... *E21B 43/26* (2013.01); *E21B 17/1057* (2013.01); *E21B 17/1078* (2013.01)

(58) Field of Classification Search
CPC ..... E21B 43/26; E21B 17/1057; E21B 17/10778
USPC ..... 166/308.1, 378, 177.5, 242.6
See application file for complete search history.

(56) References Cited

U.S. PATENT DOCUMENTS

| | | | | |
|---|---|---|---|---|
| 4,363,360 | A * | 12/1982 | Richey | 166/241.7 |
| 4,595,058 | A * | 6/1986 | Nations | 166/285 |
| 4,787,457 | A * | 11/1988 | Webster et al. | 166/286 |
| 5,095,981 | A * | 3/1992 | Mikolajczyk | 166/241.6 |
| 5,107,927 | A * | 4/1992 | Whiteley et al. | 166/50 |
| 5,249,628 | A * | 10/1993 | Surjaatmadia | 166/308.1 |
| 5,472,049 | A * | 12/1995 | Chaffee et al. | 166/250.1 |
| 5,603,379 | A * | 2/1997 | Henke et al. | 166/297 |
| 7,861,788 | B2 * | 1/2011 | Tips et al. | 166/319 |
| 8,393,392 | B2 * | 3/2013 | Mytopher et al. | 166/297 |
| 2003/0164236 | A1 * | 9/2003 | Thornton | 166/278 |
| 2010/0236781 | A1 * | 9/2010 | Mytopher et al. | 166/297 |

* cited by examiner

*Primary Examiner* — Elizabeth Gitlin

(57) ABSTRACT

A self-orientating fracturing system including a swivel sub having opposing sections rotatable relative to one another; at least one ported sleeve defining a flowpath and having a ported housing with an outer surface that includes at least one planar engagement surface and at least one port providing a communication path to the interior of said housing, and an insert moveable within the ported housing between a first position and a second position, for opening and closing the ported sleeve. The system includes a centralizer having an outer surface configured to impart rotational force to the centralizer when the centralizer is pushed or culled alone the surface of a wellbore. The sorted sleeve and the centralizer are installed in the assembly on the same side of the swivel sub such that the rotational force imparted to the centralizer is also imparted to the swivel sub.

16 Claims, 5 Drawing Sheets

SELF-ORIENTING FRACTURING SLEEVE AND SYSTEM

CROSS-REFERENCES TO RELATED APPLICATIONS

This original non-provisional application claims benefit of and priority to U.S. Provisional Application Ser. No. 61/381,376, filed Sep. 9, 2010 and entitled "Self-Orienting Fracturing Sleeve and System," which is incorporated by reference herein.

STATEMENT REGARDING FEDERALLY SPONSORED RESEARCH OR DEVELOPMENT

Not applicable.

BACKGROUND OF THE INVENTION

1. Field of the Invention

The present invention relates to oil and natural gas production. More specifically, the invention is a system and method for fracturing within a limited range or within a specifically-desired direction within a hydrocarbon production zone.

2. Description of the Related Art

In hydrocarbon wells, fracturing (or "fracing") is a technique used by well operators to create and extend fractures from the wellbore into the surrounding formation, thus increasing the surface area for formation fluids to flow into the well. Fracing is typically accomplished by either injecting fluids into the formation at high pressure (hydraulic fracturing) or injecting fluids laced with round granular material (proppant fracturing) into the formation. In either case, the fluids are pumped into the tubing string and into the formation through ports disposed in downhole tools, such as fracing valves.

Some productions zones present particular difficulties due to their thinness. For example, a particular zone may be only ten, fifty or one-hundred feet thick, presenting only a thin layer of formation in which to drill a lateral wellbore. Moreover, fracing vertically past (i.e., either above or below) the production zone can allow the introduction of production impediments into the production zone, such as if, for example, a volume of water is positioned above and within the fracing range of the tool. Fracing past the production zone vertically downward presents the possibility of providing an egress path out of the production zone.

BRIEF SUMMARY OF THE INVENTION

The present invention addresses these and other problems associated with the fracing in relatively thin production zones. The system comprises a swivel sub having a connection radially rotatable relative to the tubing string portion located upwell; at least one ported sleeve positionable downwell of said swivel sub, said at least one ported sleeve defining a flowpath and comprising a ported housing having an outer surface with at least one planar engagement surface and at least one port providing a communication path to the interior of said housing; and an insert moveable within said ported housing between a first position and a second position, wherein in said first position said insert is positioned radially between said at least one port and said flowpath. The system further comprises a centralizer having a outer surface with at least one flute formed therein, said centralizer positionable downwell of said swivel sub.

DETAILED DESCRIPTION OF THE INVENTION

When used with reference to the figures, unless otherwise specified, the terms "upwell," "above," "top," "upper," "downwell," "below," "bottom," "lower," and like terms are used relative to the direction of normal production through the tool and wellbore. Thus, normal production of hydrocarbons results in migration through the wellbore and production string from the downwell to upwell direction without regard to whether the tubing string is disposed in a vertical wellbore, a horizontal wellbore, or some combination of both. Similarly, during the fracing process, fracing fluids move from the surface in the downwell direction to the portion of the tubing string within the formation.

Figure 1:
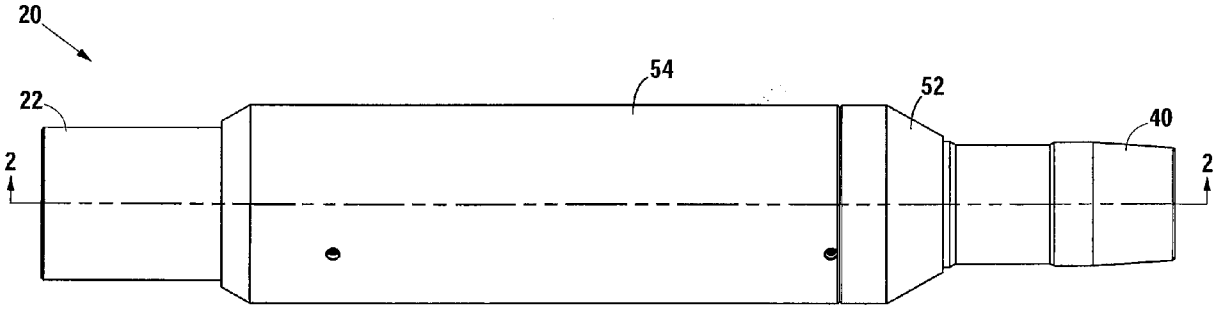
FIG. 1 is a side elevation of a preferred embodiment of the swivel sub of the present invention.
Figure 2:
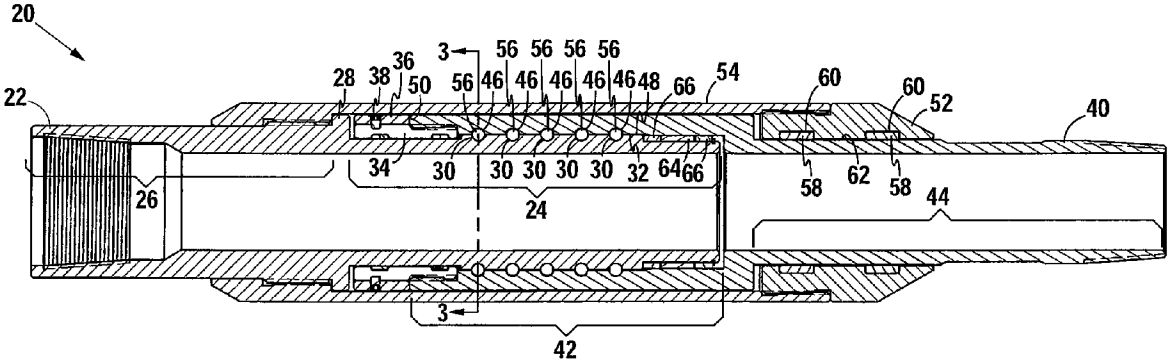
FIG. 2 is a sectional of the swivel sub of FIG. 1 through section line 2-2 of FIG. 1.
Figure 3:
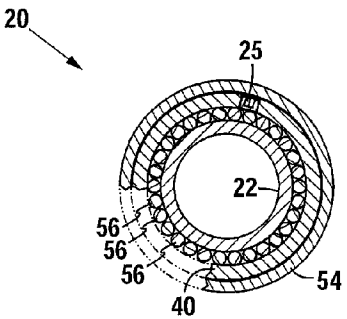
FIG. 3 is a sectional elevation of the swivel sub of FIG. 1 through section line 3-3 of FIG. 2.

FIGS. 1-3 show a swivel sub 20 of the preferred embodiment of the system. The swivel sub 20 comprises a top connection 22 having a lower portion 24 and an upper portion 26 separated by a middle shoulder 28. A plurality of bearing grooves 30 are formed in the outer surface 32 of the lower portion 24. A split ring 34 is positioned downwell of and adjacent to the middle shoulder 28. A split ring retainer 36 is fastened to the split ring 34 with a plurality of grub screws 38 radially aligned therearound.

A lower connection 40 comprises an upper portion 42 and a lower portion 44. The upper portion 42 partially encompasses the lower portion 24 of the top connection 22 and has a plurality of bearing grooves 46 formed in the inner surface 48 thereof. An annular upper end 50 of the lower connection 40 is adjacent to the lower end of the split ring retainer 36. The lower portion 44 extends through a housing sub 52. A housing 54 is positioned around a portion of the top connection 22 and an upper portion of the housing sub 52. Annular bearings 58 are positioned in bearing grooves 60 formed in the interior surface 62 of the housing sub 52.

The interiors of the top connection 22 and lower connection 40 form a longitudinal flowpath through the swivel sub 20. The flowpath is substantially sealed from the surrounding formation by annular seal stack 64 bounded by annular seal spacers 66.

A plurality of balls 56 is positioned in the annular bearing channels formed by placement of the lower connection 40 around the top connection 22, with bearing grooves 30, 46 aligned. As shown in FIG. 3, access to the channels is through a passage blocked by a grub screw 25. Although FIG. 3 shows a single channel filled with balls 56, each of the other four channels shown in FIG. 2 is identically shaped and contains a plurality of balls 56. Distributing torque across multiple channels housing multiple balls helps minimize any destructive effects of longitudinal torque.

Figure 4:
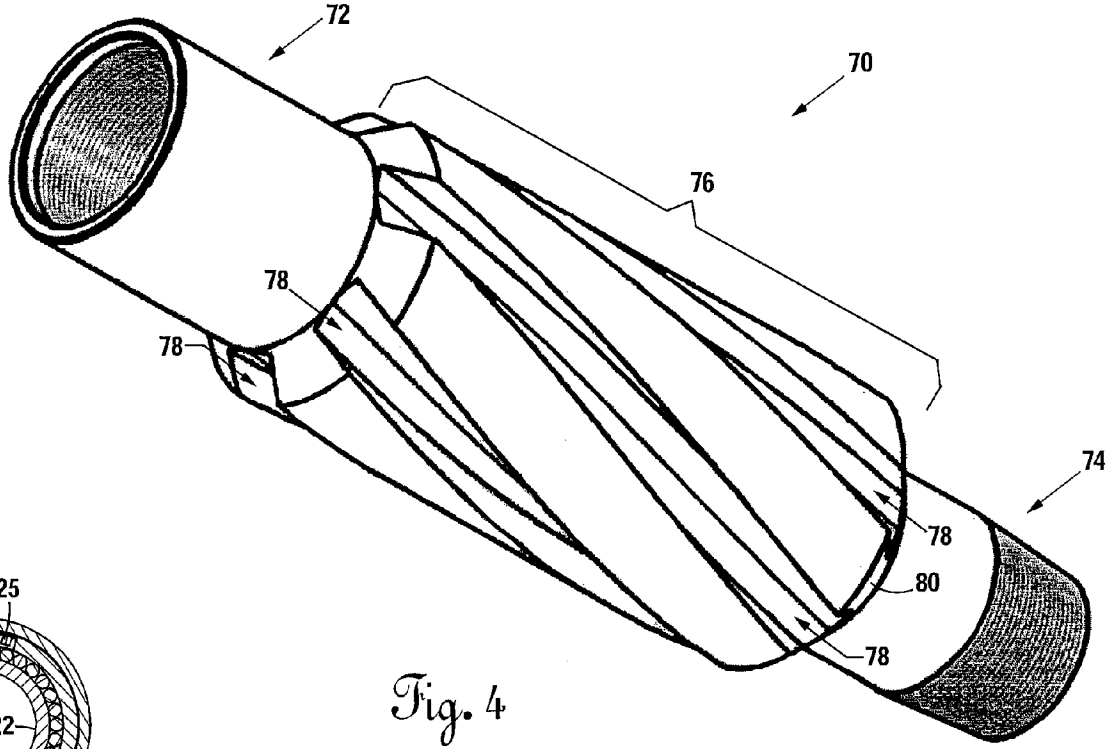
FIG. 4 is a perspective view of a preferred embodiment of the centralizer of the present invention.
Figure 5:
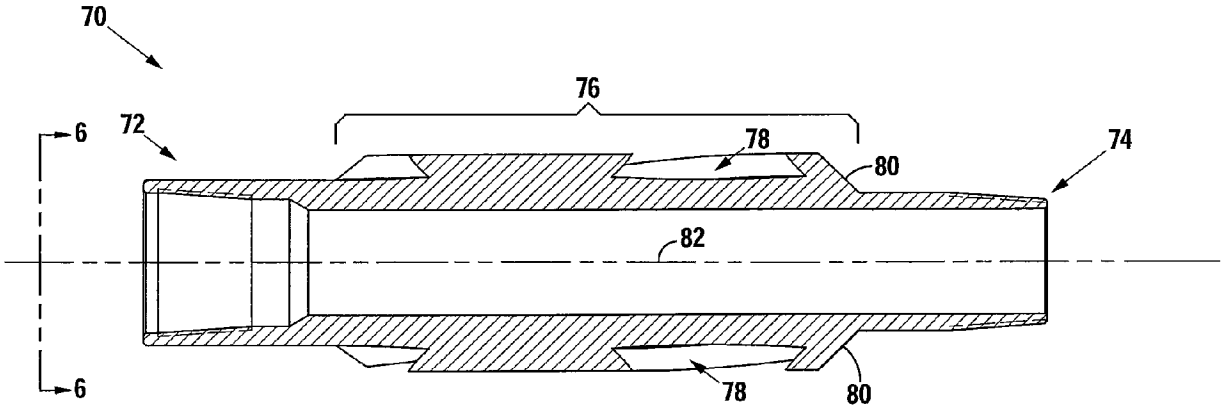
FIG. 5 is a side sectional view of the centralizer of FIG. 5 through the longitudinal center plane.
Figure 6:
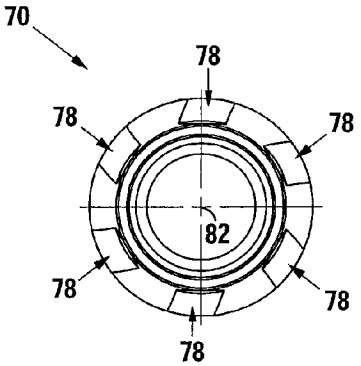
FIG. 6 is a front elevation of the centralizer.

FIGS. 4-6 show the preferred centralizer 70 of the system. The centralizer 70 has an upper end 72 and a lower end 74 for attachment to the other elements of a tubing string. A middle section 76 of the centralizer 70 has an enlarged outer diameter relative to the upper and lower ends 72, 74. Six flutes 78 are formed in the middle section 76 of the centralizer 70 spiraling around the exterior surface at six degrees per inch of rotation, and angled at thirty degrees from normal. An annular front surface 80 of the middle section 76 is angled at forty-five degrees relative to the longitudinal axis 82.

Figure 7:
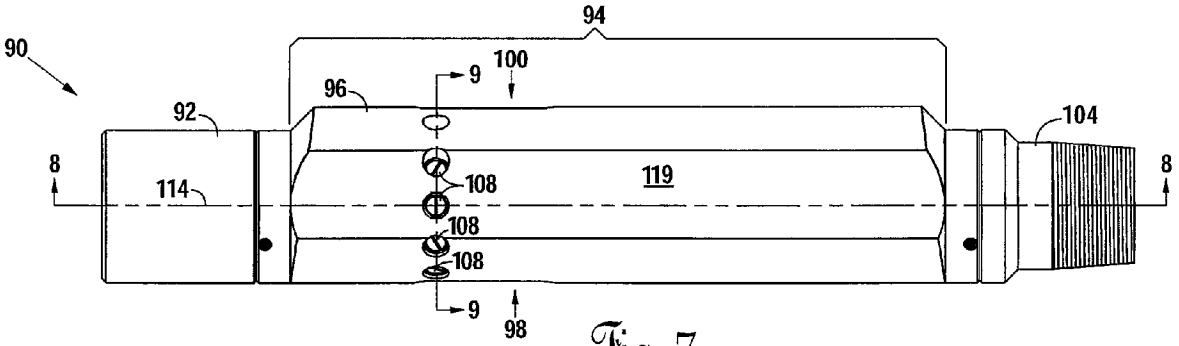
FIG. 7 is a side elevation of the low-side ported sleeve of the present invention.
Figure 8:
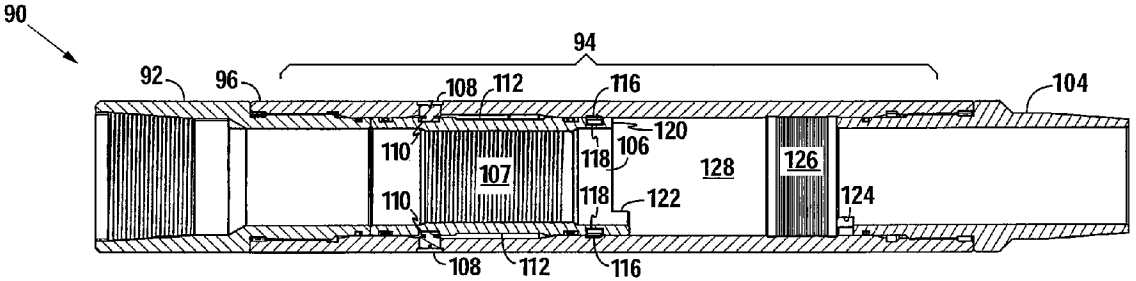
FIG. 8 is a sectional elevation through section line 8-8 of FIG. 7.
Figure 9:
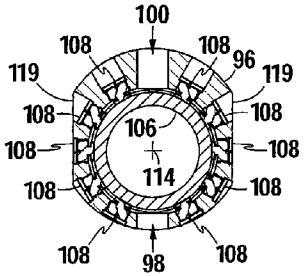
FIG. 9 is a sectional view through section line 9-9 of FIG. 7.

FIG. 7-9 show the low-side ported sleeve 90 of the system. The ported sleeve 90 comprises a top connection 92 threadedly engaged with a ported housing 96 having opposing first and second flow ports 98, 100. The lower end of the ported housing 96 is threadedly engaged with the bottom connection 104. An insert 106 having an engagable inside surface 107 is movable between a first position, shown in FIG. 8, and a second position (not shown) that is downwell from the first position.

In the first position, the insert 106 is positioned between the ports 98, 100 to at least substantially prevent fluid flow between the flowpath and the exterior of the ported sleeve 90. Shear screws 108 are positioned through the ported housing 96 and engaged with the insert 106 in a groove 110 formed in the exterior surface 112 of the insert 106.

A middle section 94 of the ported housing 96 has an asymmetrical profile around the longitudinal axis 114 of the flowpath. A ratchet ring 116 is positioned in a ratchet ring groove 118 proximate to the lower end 120 of the insert 106. The exterior surface of the middle portion 94 has opposing engagement surfaces 119.

To shift the insert 106, a shifting device (not shown) is inserted through the string and engages the inside surface 107 of the insert 106. The shifting device is caused to exert force in the downwell direction sufficient to fracture the shear screws 108 and allow the insert 106 to be moved downwell to the second position, in which locking surface 122 of the insert engages with a locking surface 124 in upper end the bottom connection 104 to prevent rotation of the insert 106. In this position, the ratchet ring 116 engages a ratchet section 126 formed in the inner surface 128 of the ported housing 96.

Figure 10:
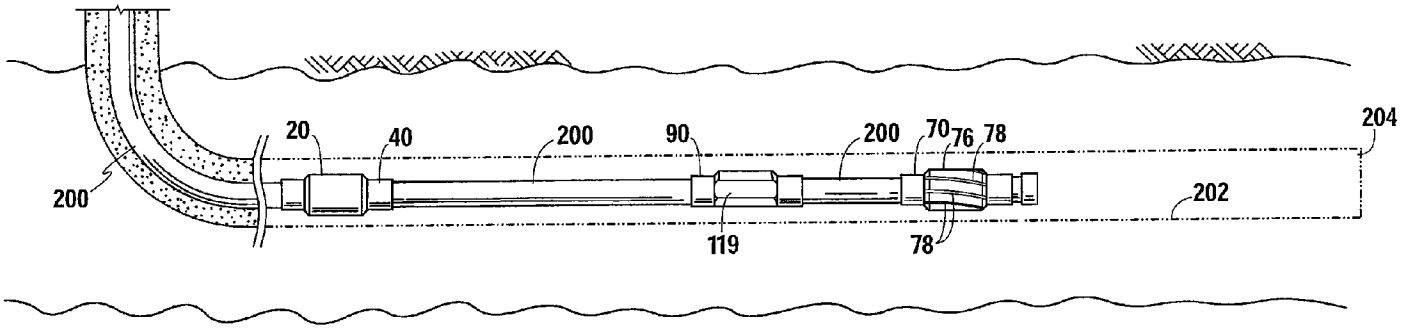
FIG. 10 shows the preferred embodiment described with reference to FIGS. 1-9 in use with a well.

As shown in FIG. 10, during use, the centralizer 70 and low-side sleeve 90 are positioned in a tubing string 200 downwell from the swivel sub 20, and are therefore freely rotatable relative to the portion of the tubing string upwell of the swivel sub 20. Thus, the engagement surfaces 119 initially may be radially orientated in any direction (e.g., parallel to the low side, or bottom surface, of the wellbore; vertical relative to the low side of the wellbore, or any rotational position in between) relative to the low side of the wellbore. Similarly, because they are positioned radially between the engagement surfaces 119, the ports 98, 100 may also be initially radially positioned in any direction, including orientated to direct fracing fluid vertically.

As the tubing string 200 is tools are run into the lateral portion of the wellbore, gravity causes the tubing string 200, centralizer 70, and ported sleeve 90 to contact the low side 202 (i.e., bottom) of the wellbore 204. When the centralizer 70 engages with the ground surface, fluted middle section 76 engages the low side of the wellbore and urges rotation of the centralizer 70 and attached tubing, including the ported sleeve 90, in the direction of flutes 78. The swivel sub 20 allows such rotation due to the rotatability of the lower connection 40 relative to the top connection 22, as described with reference to FIGS. 1-3.

If an engagement surface 119 is not already positioned against the low side 202 of the wellbore 204, rotation of the ported sleeve 90 will continue until such positioning occurs—that is, the ported sleeve 90 will be rotated along with the centralizer 70 until one of the engagement surfaces 119 substantially contacts the low side of the lateral wellbore 204. The eccentric shaping of the middle section 94 facilitates rotation by causing the center of mass to be misaligned with the flowpath's longitudinal axis.

Figure 11:
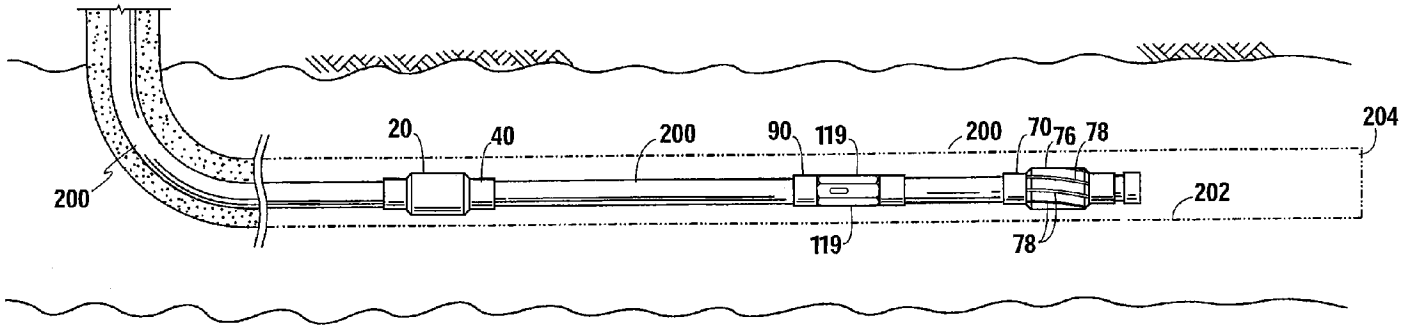
FIG. 11 shows the embodiment of FIG. 10 with the ported sleeve rotated.

When an engagement surface 119 of the low-side sleeve 90 contacts the low side 202 of the wellbore 204, frictional engagement of the engagement surface 119 is sufficient to resist the rotational urging caused by the fluted centralizer 70, after which the sleeve 90 and centralizer 70 drag straight within the wellbore as the tubing string 200 is moved further into the lateral 204. In this orientation, which is shown in FIG. 11, because they are positioned between the engagement surfaces 119, the opposing ports 98, 100 are then oriented to direct flow horizontally, rather than vertically, through the relatively thin production zone. Frictional contact of the engagement surface 119, along with the weight of the tubing string helps resists further rotational urging.

Because of the eccentricity, the low-side sleeve 90 may be run with measuring devices on the outside to make it effectively centric so that the eccentricity will not cause the tool to hang up in the well bore.

The present invention is described in terms of preferred embodiment in which a specific system and method are described. Those skilled in the art will recognize that alternative embodiments of such system, and alternative applications of the method, can be used in carrying out the present invention. Other aspects and advantages of the present invention may be obtained from a study of this disclosure and the drawings, along with the appended claims. Moreover, the recited order of the steps of the method described herein is not meant to limit the order in which those steps may be performed.

We claim:

1. A self-orientating fracing system for use in an open hole, the system comprising:

a swivel sub having:

a lower connection radially rotatable relative to a portion of a tubing string connected to the swivel sub, said portion of the tubing string located upwell of the swivel sub;

a top connection having a first upper portion and a first lower portion with an outer surface, said first lower portion having an outer diameter smaller than the outer diameter of the first upper portion, and at least one bearing groove formed in the outer surface of the first lower portion;

a lower connection having a second upper portion and a second lower portion with an inner surface, wherein the second upper portion of the lower connection encompasses at least part of said first lower portion of the top connection, and at least one bearing groove formed in the inner surface of the second upper portion;

a housing assembly encircling at least a portion of said top connection and at least a portion of the lower connection;

at least one ported sleeve located downwell of said swivel sub, the at least one ported sleeve defining a flowpath; and at least one centralizer having an outer surface comprising a plurality of flutes, the outer surface substantially radially symmetrical;

wherein, the at least one centralizer is located downwell of said swivel sub;

the at least one bearing groove formed in the outer surface of the top connection is radially aligned with the at least one bearing groove formed in the inner surface of the lower connection forming at least one annular channel between the top connection and the lower connection;

at least one bearing is positioned in the at least one annular channel; and said lower connection is radially rotatable relative to the top connection.

2. The self-orientating fracing system of claim 1 wherein said housing assembly having at least one bearing groove formed therein, and further comprising at least one annular bearing positioned in said at least one bearing groove of said housing assembly and radially between the lower connection and the housing assembly; and wherein said lower connection is readily rotatable relative to the housing assembly.

3. The self-orientating fracing system of claim 1 wherein said housing assembly comprises:

a housing connected to a housing sub, said housing being attached to the top connection, said housing sub being attached to the housing and encircling at least a portion of second lower portion of the lower connection.

4. The self-orientating fracing system of claim 1 further comprising a middle shoulder formed in said top connection between said first upper portion and said first lower portion, wherein downwell movement of said housing assembly relative to said top connection is limited by contact of said housing assembly with said middle shoulder.

5. The self-orientating fracing system of claim 4 further comprising a split ring and split ring retainer positioned around the first lower portion of said top connection, said split ring and said split ring retainer being longitudinally positioned between an annular upper end of the lower connection and the middle shoulder of the top connection.

6. The self-orientating fracing system of claim 1 wherein said lower connection has at least one radial passage therethrough, the at least one radial passage being aligned with the at least one bearing groove formed in the inner surface of the second upper portion.

7. The self-orientating fracing system of claim 1 wherein said at least one ported sleeve comprises:

a ported housing having an interior and a middle section with an asymmetrical profile and an outer surface with at least one flattened engagement surface and at least one port providing a communication path to the interior of said housing.

8. The self-orientating fracing system of claim 7 wherein the centralizer imparts rotational force to the at least one ported sleeve when the centralizer moves along the surface of the open hole.

9. The self-orientating fracing system of claim 1 wherein the centralizer imparts rotational force to the at least one ported sleeve when the centralizer moves along the surface of the open hole.

10. A self-orientating fracing system for use in an open hole, the system comprising:

a swivel sub having a lower section, an upper section at least partially overlapping with the lower section, at least one bearing channel comprising a first groove in the upper section and a second groove in the lower section, a plurality of bearings in the bearing channel, and an outer housing at least partially encircling the upper section and the lower section;

at least one centralizer having an outer surface comprising a plurality of flutes; and at least one ported sleeve between the swivel sub and the at least one centralizer, the at least one ported sleeve defining a flowpath;

wherein, the upper section and the lower section are radially rotatable relative to each other; and the housing encircles the entire portion of the upper section which overlaps with the lower section.

11. The self-orientating fracing system of claim 10 wherein the housing is a housing assembly, the housing assembly comprising a first housing sub connected to a second housing sub, the first housing sub being attached to the upper section and the second housing sub being attached to the first housing sub, wherein at least a portion of the second housing sub encircles at least a portion of the lower section.

12. The self-orienting fracing system of claim 10 wherein the centralizer will impart rotational force to the at least ported sleeve when the centralizer is moved along a surface of the open hole.

13. The self-orientating fracing system of claim 10 wherein said at least one ported sleeve comprises a ported housing having an interior, a middle section with an asymmetrical profile, an outer surface with at least one flattened engagement surface, and at least one port providing a communication path to the interior of said housing.

14. A method for installing a ported sleeve in an open hole, the method comprising:

assembling a self-orienting ported sleeve assembly, the self-orienting ported sleeve assembly comprising:

a swivel sub having a lower section, an upper section overlapping with the lower section, at least one bearing channel comprising a first groove in the upper section and a second groove in the lower section, a plurality of bearings in the at least one bearing channel, and an outer housing at least partially encircling the upper section and the lower section;

at least one centralizer having an outer surface comprising a plurality of flutes; and at least one ported sleeve on the same side of the swivel sub as the at least one centralizer, the at least one ported sleeve having a flowpath, therethrough;

placing the self-orienting sleeve assembly into the open hole;

moving the self-orienting sleeve assembly along the open hole with the at least one centralizer in contact with a surface of the open hole;

rotating the ported sleeve such that one or more ports in the ported sleeve are oriented in a desired direction; and stopping rotation of the ported sleeve when the one or more ports are oriented in the desired direction.

15. The method of claim 14 wherein the ported sleeve further comprises an assymetrical section, the method further comprising the steps of bringing an exterior surface of the assymetrical section into contact with a bottom surface of the open hole.

16. The method of claim 14 further comprising contacting the housing of the swivel sub with a surface of the open hole as the self-orienting sleeve assembly is moved along the open hole.

* * * * *